US005688117A

United States Patent [19]

May et al.

[11] Patent Number: 5,688,117

[45] Date of Patent: Nov. 18, 1997

[54] ROTATABLE HEATING CHAMBER WITH INTERNAL TUBES FOR WASTE

[75] Inventors: Karl May, Bad Vilbel; Hartmut Herm, Dreieich; Karlheinz Unverzagt, Seligenstadt; Herbert Tratz, Ottensoos; Helmut Werdinig, Nurenberg, all of Germany

[73] Assignee: Siemens Aktiengesellschaft, Munich, Germany

[21] Appl. No.: 606,482

[22] Filed: Mar. 4, 1996

Related U.S. Application Data

[63] Continuation of PCT/DE94/00974 Aug. 23, 1994, published as WO95/06697 Mar. 9, 1995.

[30] Foreign Application Priority Data

Sep. 3, 1993 [DE] Germany ..... 43 29 871.0

[51] Int. Cl.[6] ..... F27B 7/10; F27B 7/04

[52] U.S. Cl. ..... 432/103; 432/105; 432/107; 165/162

[58] Field of Search ..... 432/103, 105, 432/107, 114; 34/119, 124, 125; 165/88, 162

[56] References Cited

FOREIGN PATENT DOCUMENTS

| | | | |
|---|---|---|---|
| 157330 | 10/1985 | European Pat. Off. . | |
| 0302310 | 2/1989 | European Pat. Off. . | |
| 565954 | 10/1993 | European Pat. Off. . | |
| 1108715 | 9/1959 | Germany . | |
| 3702318 | 1/1988 | Germany . | |
| 0059197 | 3/1986 | Japan | 165/162 |

*Primary Examiner*—Henry A. Bennett
*Assistant Examiner*—Gregory A. Wilson
*Attorney, Agent, or Firm*—Herbert L. Lerner; Laurence A. Greenberg

[57] ABSTRACT

A low-temperature carbonization drum for waste includes many heating tubes located in the interior. The tubes are each secured by one end to a first end plate and by the other end to a second end plate. At least one support location for supporting the heating tubes is provided between the two end plates to prevent them from sagging. Each support location is divided into at least two spaced-apart partial supports, each with one bracket configuration. Each bracket configuration includes a plurality of support brackets that are located in the same plane as one another. The support brackets are located one after another (are staggered) and are rotationally offset from one another. As a result, the solid material in the waste can be transported largely unimpeded past the support locations.

19 Claims, 5 Drawing Sheets

ROTATABLE HEATING CHAMBER WITH INTERNAL TUBES FOR WASTE

CROSS-REFERENCE TO RELATED APPLICATION

This application is a continuation of International Application Ser. No. PCT/DE94/00974, filed Aug. 23, 1994, published as WO95/06697, Mar. 9, 1995.

BACKGROUND OF THE INVENTION

Field of the Invention

The invention relates to a heating chamber being rotatable about its longitudinal direction, for solid material, in particular a low-temperature carbonization drum for waste, having a number of heating tubes which are located in the interior and are each secured by one end to a first end plate and by an other end to a second end plate.

Such a heating chamber is used particularly as a low-temperature carbonization drum for waste, in order to carry out thermal waste disposal, preferably according to the low-temperature carbonization combustion process.

In the field of waste disposal, the so-called low-temperature carbonization combustion process has become known. The process and a system operating according to the process for thermal waste disposal are described, for instance, in Published European Patent Application 0 302 310 A1, corresponding to U.S. Pat. No. 4,878,440. The system for thermal waste disposal according to the low-temperature carbonization combustion process includes a low-temperature carbonization chamber (pyrolysis reactor) and a high-temperature combustion chamber as its essential components. The pyrolysis reactor converts the waste, which is fed through a waste conveyor of the type referred to at the outset, into low-temperature carbonization gas and pyrolysis residue. After suitable preparation, the low-temperature carbonization gas and the pyrolysis residue are then delivered to the burner of the high-temperature combustion chamber. That produces molten slag, which can be removed through an outlet and which is in vitrified form after it cools down. The flue gas being produced is sent through a flue gas line to a chimney serving as an outlet. In particular, a waste heat generator acting as a cooling device, along with a dust filter system and a flue gas scrubber system, are built into the flue gas line. Such a system has gained wide approval (see an article headlined "Schwel-Brenn-Verfahren bringt Recycling-Rekord" ["Low-Temperature Carbonization Combustion Process Sets Recycling Record"] in the newspaper Stuttgarter Zeitung, Aug. 18, 1993).

As a rule, a relatively long, rotating low-temperature carbonization drum that has many parallel heating tubes inside, in which the waste is heated largely to the exclusion of air, is used as the low-temperature carbonization chamber (pyrolysis reactor). The low-temperature carbonization drum rotates about its longitudinal axis. Preferably the longitudinal axis is inclined somewhat from the horizontal, so that the solid low-temperature carbonization material can collect at the outlet of the low-temperature carbonization drum and be removed from there through a discharge tube. Upon rotation, the waste is lifted through the heating tubes and drops down again. As a result, and due to waste coming in after it, the transport of the solid material (dust, clumps of carbon [coke], rocks, pieces of bottles, metal and ceramic parts, etc.) toward the discharge opening of the low-temperature carbonization drum is accomplished.

It has been found that for reasons of economics as well as for the sake of adequate pyrolysis and a high throughput, the low-temperature carbonization drum should be made relatively long. That means that the heating tubes located in the interior must also be correspondingly long. Depending on the material that the heating tubes are made of and on their length, they can sag in the interior, unless a remedy is provided. During the rotary motion of the low-temperature carbonization drum, that causes alternating strains and the possible attendant danger that the heating tubes will be torn out of their terminal retainer. Especially in heating tubes with a length of 20–30 m or even more, such a danger can well exist.

SUMMARY OF THE INVENTION

It is accordingly an object of the invention to provide a rotatable heating chamber with internal tubes for waste, which overcomes the hereinafore-mentioned disadvantages of the heretofore-known devices of this general type and which has at least a single support location and preferably at least two support locations in the interior to support the heating tubes.

Such a support location is to be capable of being made in the form of a retainer or a pipe leadthrough. However, that necessarily means that the free cross section of the support location, which is required for the passage of the solid material and of the low-temperature carbonization gas, is reduced. Under some circumstances that significantly hinders transportation of the solid material and low-temperature carbonization gases. The object of the invention is therefore to construct a heating chamber for solid material of the type referred to at the outset, that is rotatable about its longitudinal direction and in which supporting of the heating tubes is assured without significantly hindering the passage of the solid material and low-temperature carbonization gases.

With the foregoing and other objects in view there is provided, in accordance with the invention, a heating chamber for solid material, in particular a low-temperature carbonization drum for waste, comprising a wall having an inner surface defining an interior and a longitudinal direction about which the heating chamber is rotatable; first and second end plates; a number of heating tubes being disposed in groups in the interior, each of the heating tubes having one end secured to the first end plate and another end secured to the second end plate; at least one support location disposed between the end plates for supporting the heating tubes; and at least two support brackets being spaced apart in the longitudinal direction at the at least one support location, each of the support brackets being secured to the inner wall surface and each supporting a different one of the groups of the heating tubes.

This can also be expressed as follows: In the longitudinal direction of the heating chamber, there is at least one support location, which is divided into at least two partial support locations. At least one support bracket for one group of heating tubes is disposed at each of these partial support locations, and the support brackets of the first partial support location are rotationally offset and staggered (spaced apart) relative to the support brackets of the second partial support location, so that sufficient space between them remains for transporting the solid material and the low-temperature carbonization gas.

In accordance with another feature of the invention, the support brackets are steel and are welded to the inner wall surface.

In accordance with a further feature of the invention, the heating tubes are each from 15 to 30 m long, and the at least one support location includes from one to two support locations between the end plates depending on the length of the heating tubes, the wall has a given total length, and each support location is preferably disposed approximately one-half to one-third of the given total length from a respective one of the end plates.

In accordance with an added feature of the invention, each of the groups of the heating tubes supported by one support bracket includes mutually parallel heating tubes disposed in an approximately radial or curved row.

In accordance with an additional feature of the invention, one of the groups of the heating tubes supported by the at least one support bracket includes heating tubes disposed parallel to one another in the circumferential direction near the inner wall surface.

In accordance with yet another feature of the invention, the at least one support bracket is at least two support brackets at a support location being spaced apart by a spacing of approximately 1 m.

In accordance with yet a further feature of the invention, the support brackets have a rounded periphery.

In accordance with yet an added feature of the invention, there are provided bushes being disposed in holes formed in the support brackets, the bushes supporting the heating tubes.

In accordance with yet an additional feature of the invention, there are provided hardened half-shells applied to the heating tubes in the vicinity of the holes in the support brackets.

In accordance with again another feature of the invention, each support location is divided into at least two spaced-apart partial supports, each with one bracket configuration, and each bracket configuration includes a plurality of support brackets in the same plane.

In accordance with again a further feature of the invention, at least two of the support brackets in one of the bracket configurations have a different outer periphery.

In accordance with again an added feature of the invention, a free surface area is available between adjacent support brackets in one of the bracket configurations.

In accordance with again an additional feature of the invention, all of the bracket configurations at one of the supports have the same shape or configuration, but are rotationally offset.

In accordance with another feature of the invention, three of the supports and three of the bracket configurations are disposed at each of the support locations.

In accordance with a concomitant feature of the invention, the bracket configurations include adjacent first and second bracket configurations having first groups or nonadjacent second groups of heating tubes supported by the support brackets.

Other features which are considered as characteristic for the invention are set forth in the appended claims.

Although the invention is illustrated and described herein as embodied in a rotatable heating chamber with internal tubes for waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
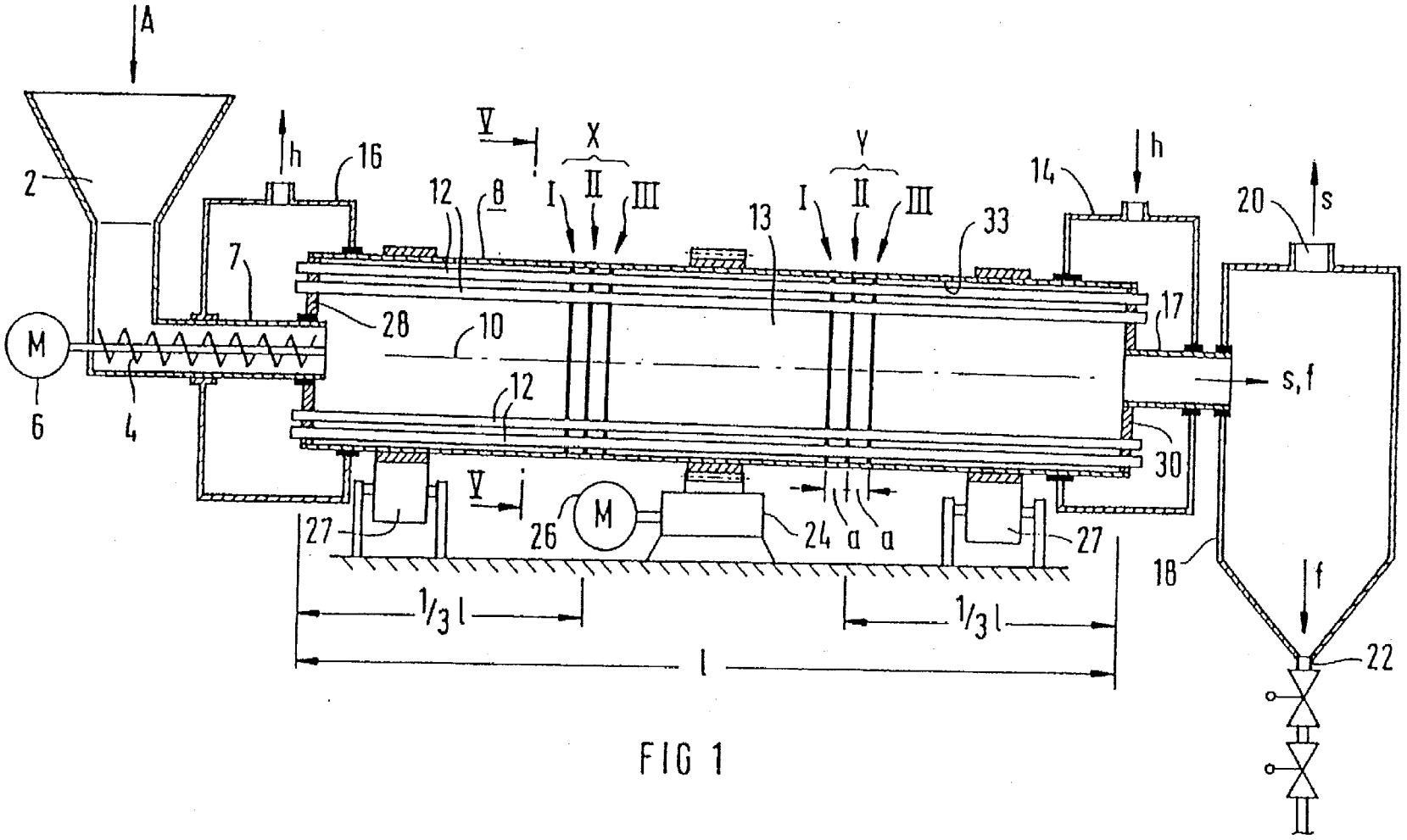
FIG. 1 is a basic diagrammatic, longitudinal-sectional view of a low-temperature carbonization system with a low-temperature carbonization chamber for waste, which can be used in a low-temperature carbonization combustion process.

Referring now to the figures of the drawing in detail and first, particularly, to FIG. 1 thereof, it is seen that solid waste A is fed centrally into a pyrolysis reactor or low-temperature carbonization chamber 8 through a delivery or feed device 2 and a worm 4, which is driven by a motor 6 and is disposed in a feed tube 7. The low-temperature carbonization chamber 8 in the exemplary embodiment is an internally heatable low-temperature carbonization or pyrolysis drum, which is rotatable about its longitudinal axis 10, which can have a length of 15 to 30 m, which functions at 300° to 600° C., which is operated largely to the exclusion of oxygen, and which produces not only volatile low-temperature carbonization gas s but also a solid pyrolysis residue f. The low-temperature carbonization drum 8 has tubes on the inside. In particular, many (for instance 50 to 200) heating tubes 12 are oriented parallel to one another and disposed in an interior 13 of the drum 8, although only four tubes are shown in FIG. 1. On the right-hand or "hot" end of the drum 8, an inlet for heating gas h is provided in the form of a horizontal, sealed-off heating gas inlet chamber 14, and on the left-hand or "cold" end, an outlet for the heating gas h is provided in the form of a horizontal, sealed-off heating gas outlet chamber 16. The longitudinal axis 10 of the low-temperature carbonization drum 8 is preferably inclined from the horizontal, so that on the right-hand, "hot" end, the outlet is located at a lower level than the inlet shown on the left for the waste A.

The pyrolysis drum 8 is followed on the outlet or discharge side by a central discharge tube 17 that rotates with it and by a discharge device 18. The discharge device 18 is provided with a low-temperature carbonization gas vent nozzle 20 for venting the low-temperature carbonization gas s, and is provided with a pyrolysis residue outlet 22 for removal of the solid pyrolysis residue f. A low-temperature carbonization gas line connected to the low-temperature carbonization gas vent nozzle 20 may be connected to a burner of a high-temperature combustion chamber.

The rotary motion of the low-temperature carbonization drum 8 about its longitudinal axis 10 is brought about by a drive 24 in the form of a gear connected to a motor 26. The drive device 24, 26 acts upon a toothed ring, for example, which is secured to the periphery of the low-temperature carbonization drum 8. Bearings of the low-temperature carbonization drum 8 are shown at reference numeral 27.

It is clear from FIG. 1 that the heating tubes 12 are each secured at one end to a first end plate 28 and at another end to a second end plate 30. The fastening to the end plates 28, 30 is carried out in such a way that easy replaceability of the heating tubes 12 preferably results. Each end of each of the heating tubes 12 protrudes through a respective opening out of the interior 13 to the left into the outlet chamber 16 or to the right into the inlet chamber 14. The axes of the heating tubes 12 are oriented perpendicular to the surfaces of the end plates 28, 30. In the construction shown, it has been noted that the various heating tubes 12 are under a severe thermal and mechanical load, and that the end plates 28, 30, which can also be referred to as tube plates or drum tube sheets, also rotate about the longitudinal axis 10 of the low-temperature carbonization drum 8.

Figure 3:
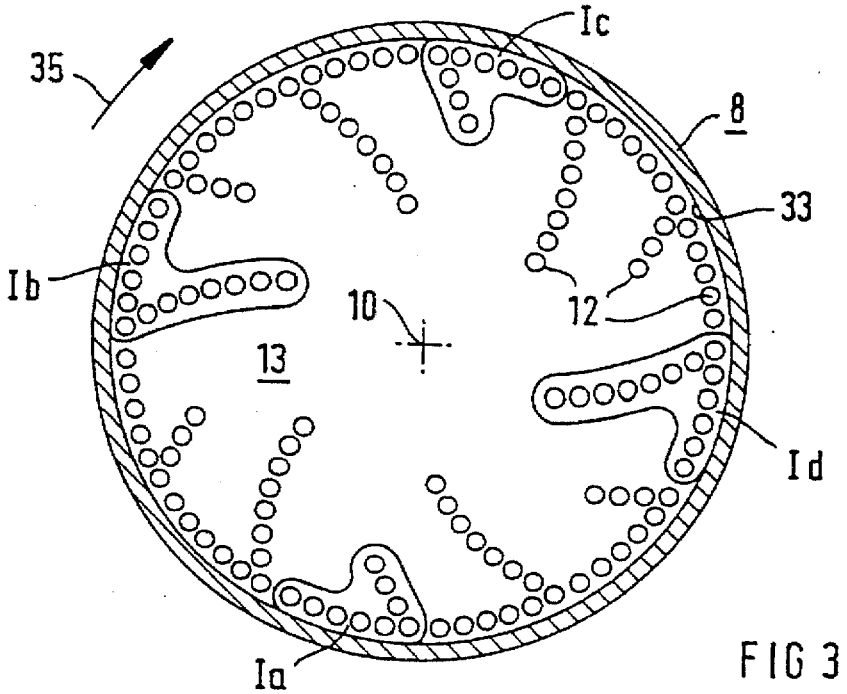
FIG. 3 is a cross-sectional view of the bracket configuration I of FIG. 2.
Figure 4:
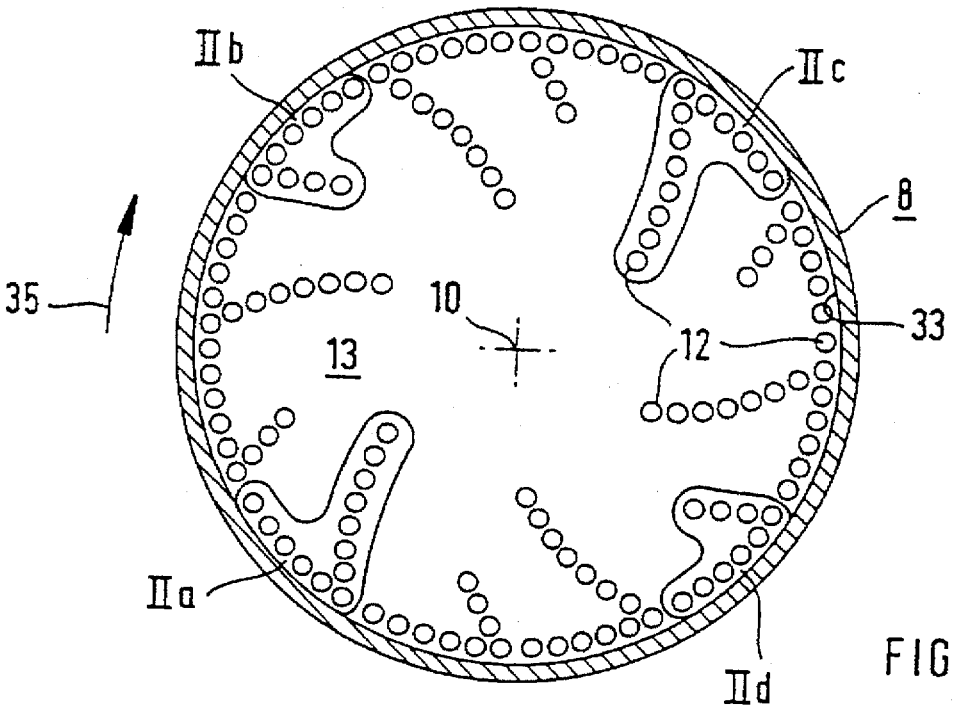
FIG. 4 is a cross-sectional view of the bracket configuration II of FIG. 2.
Figure 5:
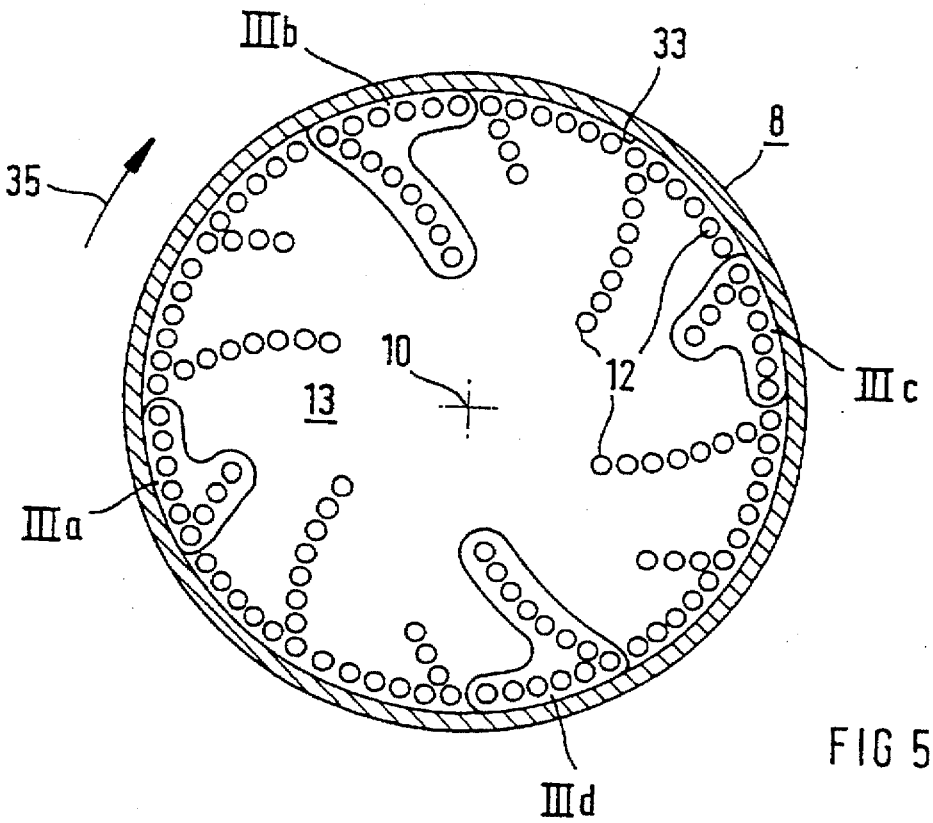
FIG. 5 is a cross-sectional view of the bracket configuration III of FIG. 2.

A significant feature is that two support locations X, Y are provided between the end plates 28, 30 to support the heating tubes 12 (which otherwise would possibly sag). As seen in terms of the feeding direction of the waste A, the first support location X is located at one-third (⅓ l) and the second support location Y at two-thirds (⅔ l) of the total length l of the low-temperature carbonization drum. Another significant factor is that each support location X, Y is divided into p=3 partial supports, each of which is spaced apart from one another by a spacing a and each of which is assigned one respective bracket configuration I, II and III. The spacing a may, for example, be a=1 m. Each of the bracket configurations I, II, III (see FIGS. 3–5) includes a plurality of bearing or support brackets, in the same plane, in the form of rounded perforated plates of metal, such as steel. In FIGS. 3–5, these support brackets are identified by the reference symbols Ia, Ib, Ic, Id, and IIa, IIb, IIc, IId, and IIIa, IIIb, IIIc, IIId. In another words, the first bracket configuration I of FIG. 3 includes the support brackets Ia, Ib, Ic and Id, which are secured, preferably welded, spaced apart from one another and rotationally offset on an inner wall surface 33. Each two support brackets Ia, Ic and Ib, Id form a pair of brackets having the same (externally rounded) configuration. As explained, the support brackets are in particular metal plates provided with holes. Correspondingly, the second bracket configuration II of FIG. 4 has the support brackets IIa, IIb, IIc and IId being rotationally offset in the same plane. Once again, two of the support brackets IIa, IIc and IIb, IId at a time which face one another have this same rounded-off configuration. Correspondingly, as is shown in FIG. 5, the third bracket configuration III has the four support brackets IIIa, IIIb, IIIc and IIId, which are spaced apart and rotationally offset from one another and located in the same plane. In the third bracket configuration III of FIG. 5 as well, the two facing support brackets IIIa, IIIc on one hand and IIIb, IIId on the other hand, that are secured to the inner wall surface 33, are constructed in the same way.

The following should be emphasized once again: the plane of the support brackets Ia–Id of FIG. 3 is offset from the plane of the support brackets IIa–IId of FIG. 4 by the distance a as seen in the longitudinal direction. The same is true for the plane of the support brackets IIIa–IIId of FIG. 5, wherein once again, the spacing distance is a.

Figure 2:
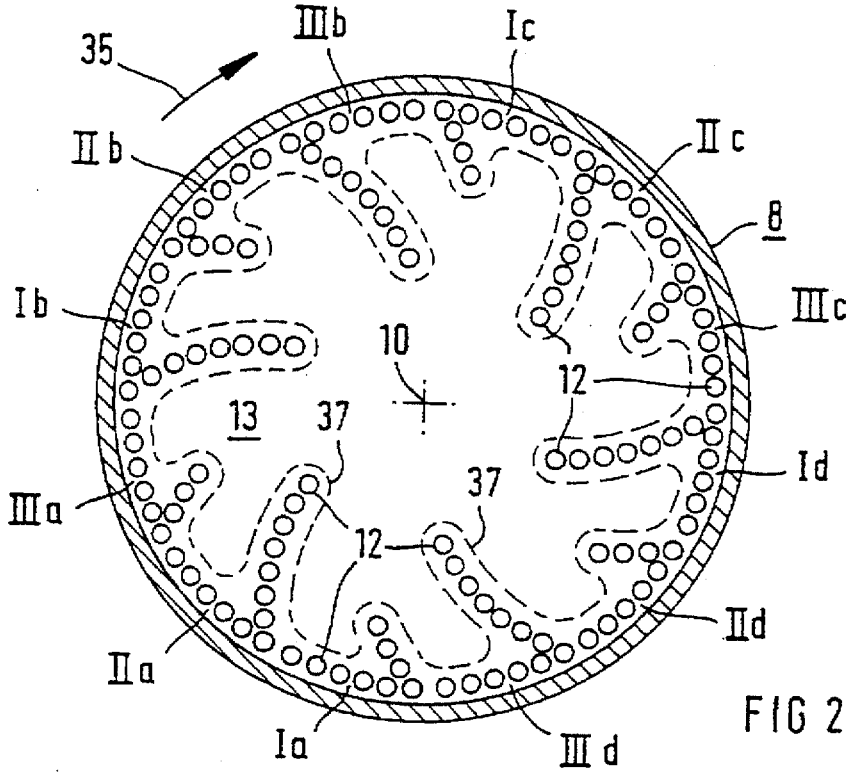
FIG. 2 is a cross-sectional view taken along the direction of the line V—V of FIG. 1 showing a first predetermined configuration of heating tubes in the low-temperature carbonization drum, with groups of heating tubes being disposed in bracket configurations I, II and III, where p=3, and with individual support brackets being omitted.

The heating tubes 12 may be disposed in a configuration shown in FIG. 2 and in FIGS. 3–5. Accordingly, there are many peripherally disposed heating tubes 12 and many heating tubes 12 disposed approximately radially (along curved lines), for heating the more centrally located waste. The curvature depends on the rotation of the low-temperature carbonization drum 8, which is represented by an arrow 35.

It is assumed in FIG. 2 that all of the heating tubes 12 are combined and supported at a support location X or Y by a single pipe clamp 37 (shown in dashed lines). It is apparent that a free cross section which is available for transporting of the solid material f is then merely restricted. In the example of FIG. 2, it should make up only approximately half of the drum cross section. In other words, the other half would be blocked for the passage of the solid material f through it. In this case the division of the entire pipe clamp 37 into the individual support brackets, which are rotationally offset and spaced apart from one another as shown in FIGS. 3–5, provides a remedy.

Each of the support brackets Ia–IIId of FIGS. 3–5 supports or retains only a certain group of all of the heating tubes 12 in accordance with a predetermined geometrical configuration. The individual groups which are especially shown per bracket configuration I, II or III are spaced apart from one another in the circumferential direction. The result is the aforementioned rotational offset and spacing apart of the support brackets. For example, the group of tubes associated with the support bracket Ia (FIG. 3) includes six peripherally located and three approximately radially located heating tubes 12, and the group of support brackets IIId (FIG. 5) includes six peripherally and seven approximately radially disposed heating tubes 12. The free cross section in the interior 13 for the transporting of the solid material f is visible from each of FIGS. 3–5. This is the space that is not occupied by the heating tubes 12 and the support brackets Ia–IIId. By comparison, this free cross section is somewhat larger, in each bracket configuration I, II, III, than in the case where there is a single support location as in FIG. 2 (with the pipe clamp 37 shown in dashed lines for all of the heating tubes 12). A comparatively unimpeded transport of the solid material f through the support locations X and Y is therefore obtained.

It should also be emphasized that the configurations, or in other words the placements, of the support brackets IIa–IId and IIIa–IIId of FIGS. 4 and 5 can be transposed. In other words, after such a transposition, the fastening configuration of FIG. 4 would pertain to the bracket configuration III, and the fastening configuration of FIG. 5 would apply to the bracket configuration II.

Figure 6:
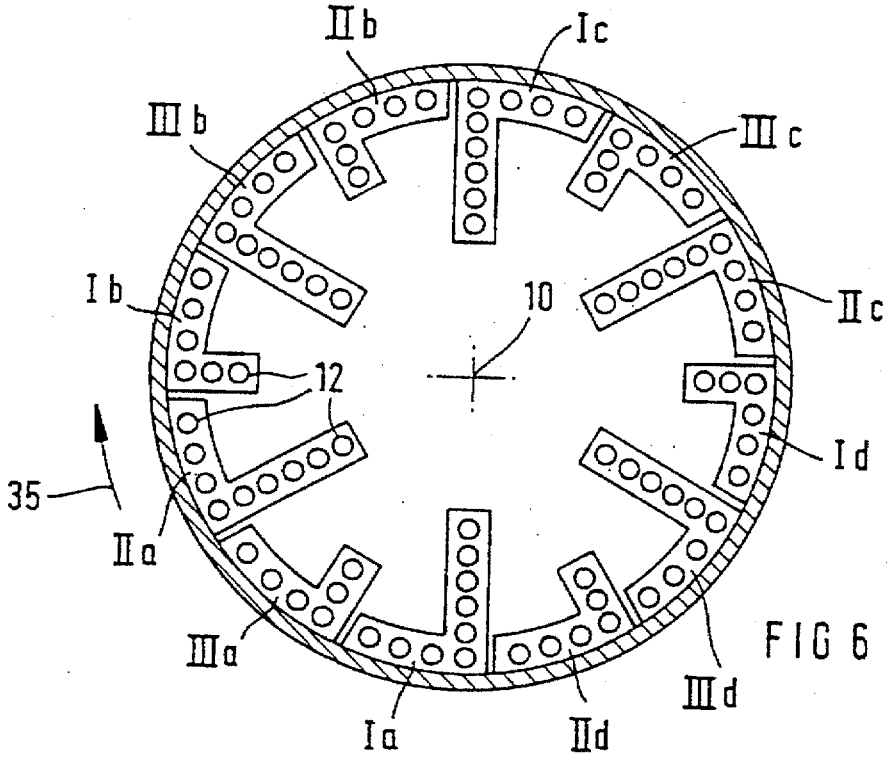
FIG. 6 is a view similar to FIG. 2 of a second configuration of heating tubes, where p=3.

In FIG. 6, once again p=3 spaced-apart partial supports are provided at each support location X, Y. Each bracket configuration I, II and III again includes four support brackets Ia–Id, IIa–IId and IIIa–IIId, respectively, each in the same plane. However, a different configuration of heating tubes 12 from that of FIG. 2 is chosen in this case. In the present case, the heating tubes 12 succeed one another as follows: six tubes are located radially side by side, three tubes are located side by side along the circumference, three tubes are located side by side radially, and finally three tubes are again distributed along the circumference, and so forth. In the present case, the view taken along the direction V—V of FIG. 1 again shows the configuration of all of the heating tubes 12 and the support brackets Ia–IIId, each being associated with groups of these heating tubes 12. Support brackets which are adjacent one another in the circumferential direction once again have a different outer periphery. The support brackets Ia–IIId in this case are constructed polygonally. It is notable that, as viewed in the direction of rotation of the arrow 35, the support bracket Ia is followed by the support bracket IIIa, which is followed by the support bracket IIa. This means that considerable free space for passage is available for the waste A between the two bracket configurations I and II. In this case as well it becomes clear that the surface area projected in accordance with the view along the direction V—V at each partial support has sacrificed relatively little of its transport carrying capacity from the inclusion of the individual support brackets Ia–IIId. Once again, a large free cross section is available, and the waste A in the form of the solid material f along with the low-temperature carbonization gases s can "snake" its way, as it were, through both the support location X divided into partial supports and the support location Y.

Figure 7:
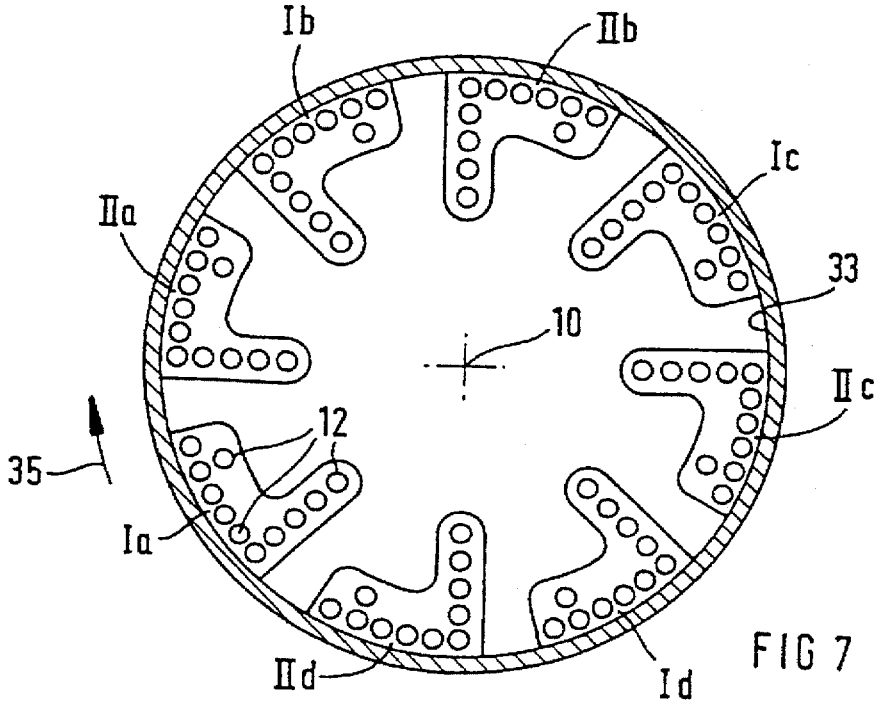
FIG. 7 is a view similar to FIG. 2 of a third configuration of heating tubes, where p=2.

The same is true in the final analysis for the embodiment of FIG. 7. In this case, only p=2 spaced-apart partial supports are provided per support location X and Y. The configuration of heating tubes 12 in the interior 33 is chosen once again to be somewhat different. In this case, each support bracket Ia–IId has two radial groups (with four heating tubes and one heating tube, respectively) and a single subgroup, located along the circumference, that has six heating tubes 12. It is notable in this case that a certain spacing is present between the individual brackets Ia–IId, so that once again waste can be transported through them.

Figure 8:
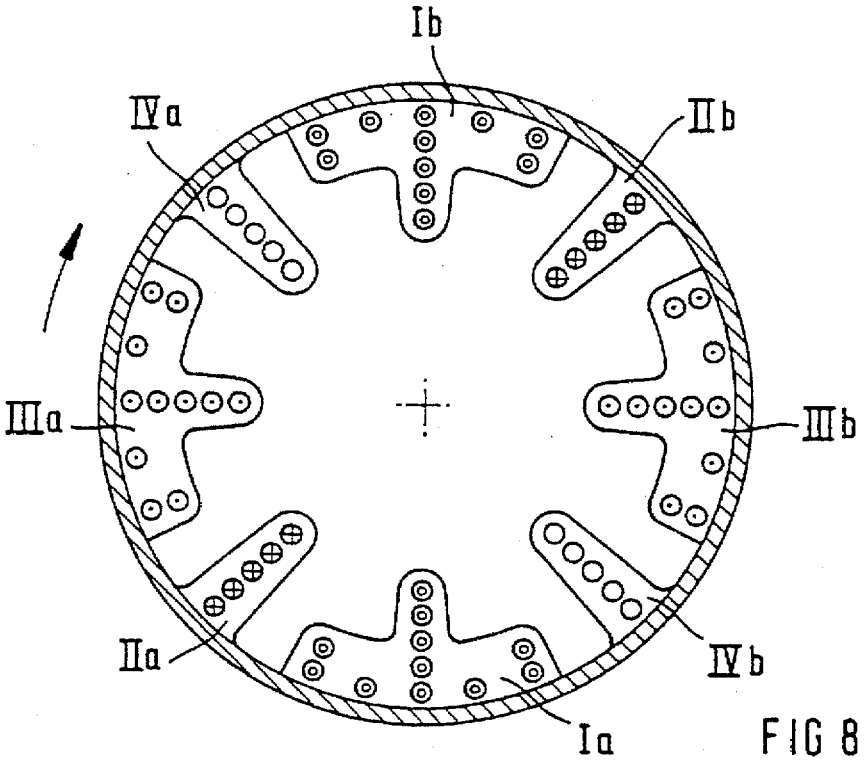
FIG. 8 is a view similar to FIG. 2 of a fourth configuration of heating tubes, where p=4.

In the configuration of FIG. 8, it is assumed that p=4 different partial support locations are present, and one bracket configuration I–IV is assigned to each of these partial supports. The support brackets that belong to one bracket configuration I–IV are each located facing one another. For instance, the support brackets Ia and Ib face one another. They have the same rounded Configuration. The same is correspondingly true for the support brackets IIa, IIb of the second bracket configuration II. The individual heating tubes 12 that belong to one and the same group and are thus combined together by one and the same support bracket are represented in the drawing by identical symbols. In this case there are only two different kinds of bracket configurations, which makes their production quite simple.

Figure 9:
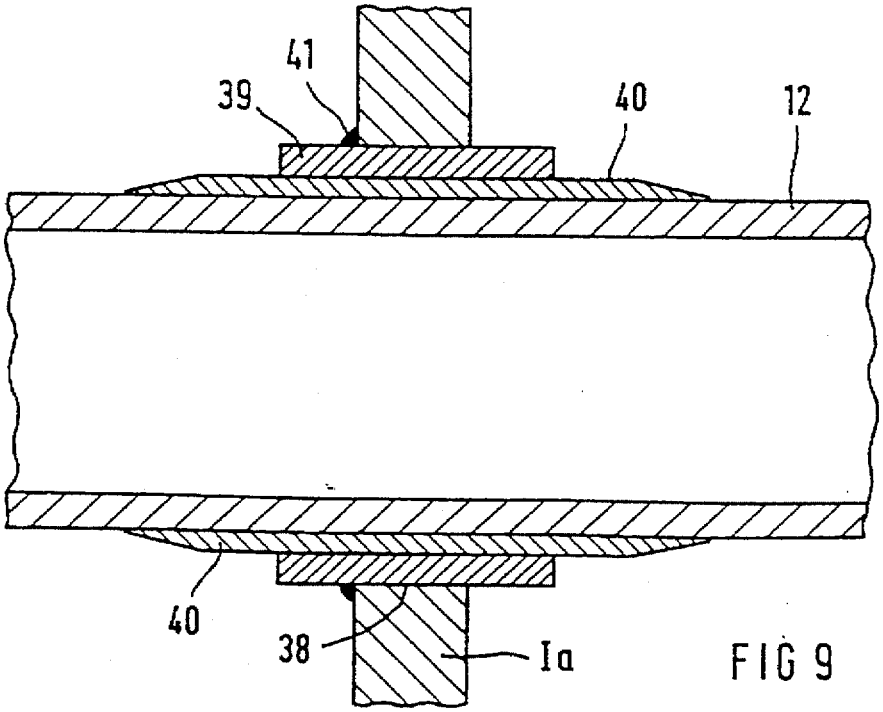
FIG. 9 is an enlarged, fragmentary, longitudinal-sectional view of a heating tube fastening in a support bracket.

FIG. 9 shows a section through a support bracket, for instance the support bracket Ia. It is clear from this drawing that this support bracket Ia in the region shown has a hole 38, through which the heating tube 12 is passed. Hardened half-shells 40 of metal are secured to this heating tube 12. These half-shells 40 in turn are located in a hardened bush 39, which fills up the hole 38 in the support bracket Ia. The hardened bush 39 is secured in the opening 38 with the aid of a weld seam 41.

In summary, it can be stated that experience shows that as a rule, heating tubes with a length l of 15 to 30 m require two support locations X and Y. Otherwise, excessive sagging of the heating tubes 12 would result, because of the weight of these heating tubes 12 and the waste A resting on them. In order to assure feeding of waste without backups, each support location X and Y is constructed in staggered fashion. In the preferred exemplary embodiment, each support location X, Y has a group of three bracket configurations I, II, III. This staggering keeps the resistance offered to the feeding of waste in the heating drum 12 within reasonable limits.

We claim:

1. A heating chamber for solid material, comprising:

a wall having an inner surface defining an interior and a longitudinal direction about which the heating chamber is rotatable;

first and second end plates;

a number of heating tubes being disposed in groups in said interior, each of said heating tubes having one end secured to said first end plate and another end secured to said second end plate;

at least one support location disposed between said end plates for supporting said heating tubes; and at least two support brackets being spaced apart in the longitudinal direction at said at least one support location, each of said support brackets being secured to said inner wall surface and each supporting a different one of said groups of said heating tubes.

2. The heating chamber according to claim 1, wherein said support brackets are steel and are welded to said inner wall surface.

3. The heating chamber according to claim 1, wherein said heating tubes are each from 15 to 30 m long, and said at least one support location includes from one to two support locations between said end plates depending on the length of said heating tubes.

4. The heating chamber according to claim 3, wherein said wall has a given total length, and each support location is disposed approximately one-half to one-third of said given total length from a respective one of said end plates.

5. The heating chamber according to claim 1, wherein each of said groups of said heating tubes supported by one support bracket includes mutually parallel heating tubes disposed in an approximately radial row.

6. The heating chamber according to claim 1, wherein each of said groups of said heating tubes supported by one support bracket includes mutually parallel heating tubes disposed in an approximately curved row.

7. The heating chamber according to claim 1, wherein one of said groups of said heating tubes supported by said at least one support bracket includes heating tubes disposed parallel to one another in the circumferential direction near said inner wall surface.

8. The heating chamber according to claim 1, wherein said at least one support bracket is at least two support brackets at a support location being spaced apart by a spacing of approximately 1 m.

9. The heating chamber according to claim 1, wherein said support brackets have a rounded periphery.

10. The heating chamber according to claim 1, including bushes being disposed in holes formed in said support brackets, said bushes supporting said heating tubes.

11. The heating chamber according to claim 10, including hardened half-shells applied to said heating tubes in the vicinity of said holes in said support brackets.

12. The heating chamber according to claim 1, wherein each support location is divided into at least two spaced-apart supports each having one bracket configuration, and each of said bracket configurations includes a plurality of said support brackets located in the same plane.

13. The heating chamber according to claim 12, wherein at least two of said support brackets in one of said bracket configurations have a different outer periphery.

14. The heating chamber according to claim 12, wherein a free surface area is available between adjacent support brackets in one of said bracket configurations.

15. The heating chamber according to claim 12, wherein all of said bracket configurations at one of said supports have the same shape, but are rotationally offset.

16. The heating chamber according to claim 12, wherein three of said supports and three of said bracket configurations are disposed at each of said support locations.

17. The heating chamber according to claim 12, wherein said bracket configurations include adjacent first and second bracket configurations having first groups of heating tubes supported by said support brackets.

18. The heating chamber according to claim 12, wherein said bracket configurations include adjacent first and second bracket configurations having nonadjacent second groups of heating tubes supported by said support brackets.

19. A low-temperature carbonization drum for waste, comprising:

a wall having an inner surface defining an interior and a longitudinal direction about which the heating chamber is rotatable;

first and second end plates;

a number of heating tubes being disposed in groups in said interior, each of said heating tubes having one end secured to said first end plate and another end secured to said second end plate;

at least one support location disposed between said end plates for supporting said heating tubes; and at least two support brackets being spaced apart in the longitudinal direction at said at least one support location, each of said support brackets being secured to said inner wall surface and each supporting a different one of said groups of said heating tubes.

* * * * *